United States Patent [19]

Pierrat

[11] Patent Number: 5,004,404

[45] **Date of Patent: * Apr. 2, 1991**

[54] VARIABLE POSITIVE FLUID DISPLACEMENT APPARATUS WITH MOVABLE CHAMBERS

[76] Inventor: Michel Pierrat, 2355 24th St., Boulder, Colo. 80302

[ * ] Notice: The portion of the term of this patent subsequent to Mar. 13, 2007 has been disclaimed.

[21] Appl. No.: 305,810

[22] Filed: Feb. 3, 1989

Related U.S. Application Data

[63] Continuation-in-part of Ser. No. 238,093, Aug. 29, 1988, Pat. No. 4,907,950.

[51] Int. Cl.[5] ..... F04B 1/10

[52] U.S. Cl. ..... 917/53; 417/273; 417/467; 74/600; 74/603; 74/837

[58] Field of Search ..... 417/466, 467, 273, 53; 91/460, 467, 491, 492, 493; 74/600, 601, 603, 837

[56] References Cited

U.S. PATENT DOCUMENTS

| | | | |
|---|---|---|---|
| 2,130,037 | 9/1938 | Skärlund | 417/466 |
| 2,366,186 | 1/1945 | Freeman | 417/514 |
| 2,544,055 | 3/1951 | Staats | 91/481 X |
| 4,271,720 | 6/1981 | Jacob | 74/603 X |
| 4,485,768 | 12/1984 | Heniges | 74/600 X |
| 4,563,131 | 1/1986 | Bookout et al. | 417/221 |
| 4,569,639 | 2/1986 | Hannibal et al. | 417/902 X |

FOREIGN PATENT DOCUMENTS

| | | | |
|---|---|---|---|
| 466647 | 7/1946 | Belgium . | |
| 0563134 | 6/1960 | Belgium | 417/466 |
| 184042 | 11/1985 | European Pat. Off. . | |
| DE-A-3211261 | 12/1983 | Fed. Rep. of Germany . | |
| 3621131A1 | 6/1987 | Fed. Rep. of Germany . | |
| 0591125 | 8/1947 | United Kingdom | 417/466 |

*Primary Examiner*—Leonard E. Smith
*Assistant Examiner*—Eugene L. Szczecina, Jr.
*Attorney, Agent, or Firm*—E. T. Barrett

[57] ABSTRACT

Rectangular pistons are driven in a circular orbit by two spaced eccentrics on a common crankshaft. The displacement chambers reciprocate with a lateral motion parallel with the crankshaft. The radial forces created by the fluid pressure in the displacement chambers are balanced by a connection to the crankshaft through rotatable and slidable antifriction bearings. During the reciprocating lateral motion of the chambers, port openings located in the outer ends of the chambers are connected alternately to matching intake and exhaust port openings in the adjacent surfaces of the casing to provide a reversible valveless control of the fluid to and from the chambers. The apparatus can be used either as a pump or motor without internal modifications. The pistons are secured together as one piece and follow identical orbital paths. Each pair of opposing displacement chambers are secured as one piece and radially connected to the crankshaft. The displacement of the apparatus is continuously variable from zero to its maximum. The apparatus is dynamically balanced by two counterweights, with adjustable eccentricities.

11 Claims, 11 Drawing Sheets

FIG. 4
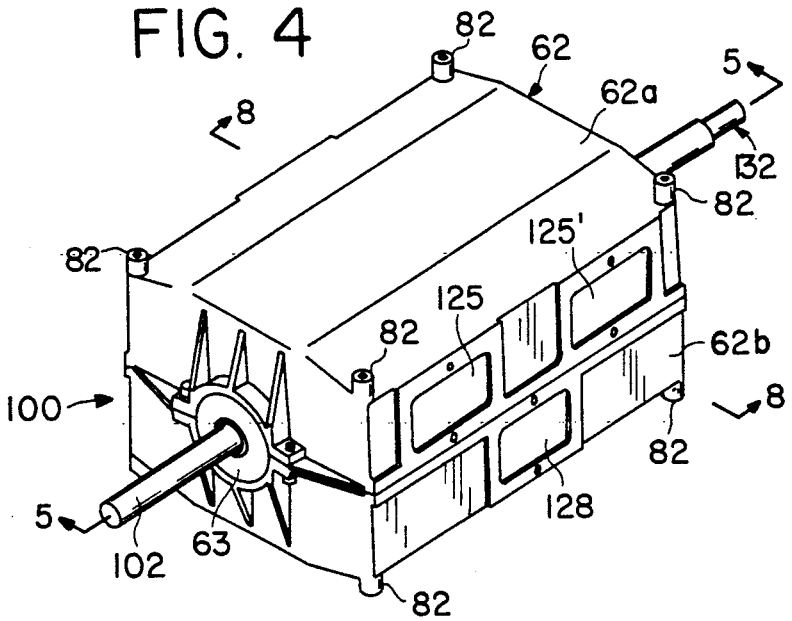
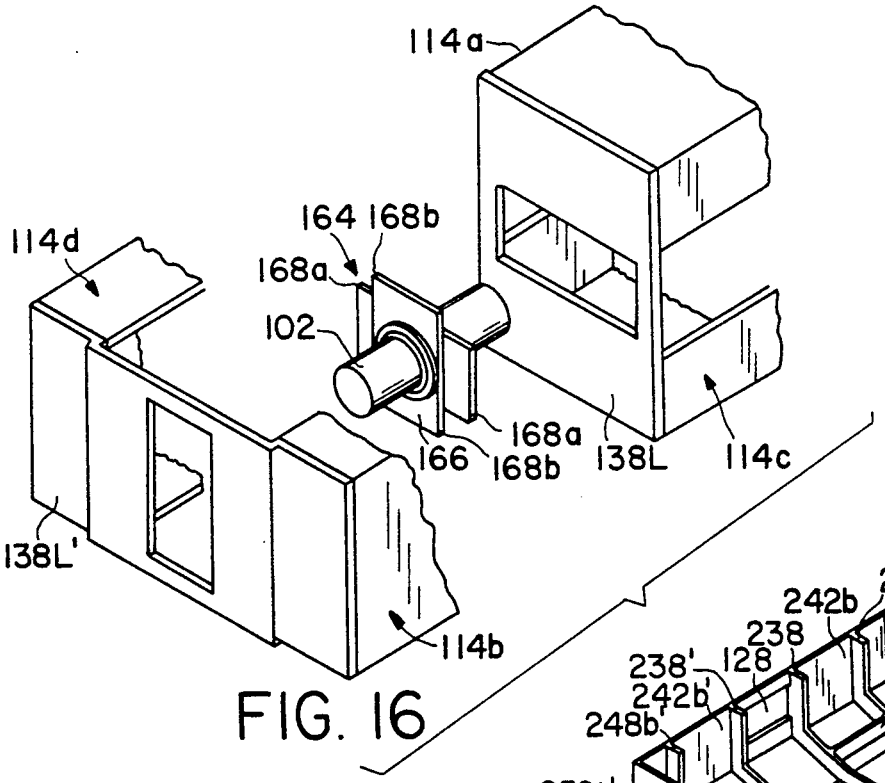
FIG. 16
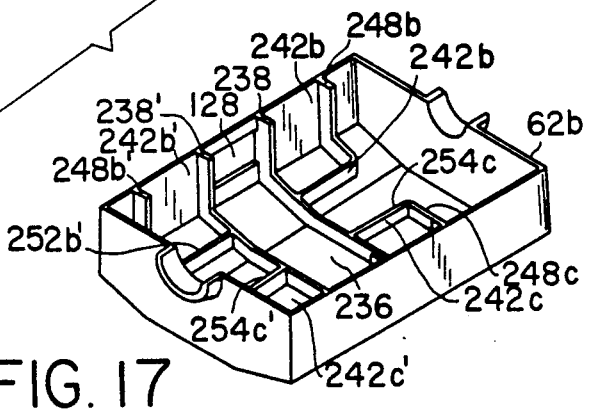
FIG. 17

VARIABLE POSITIVE FLUID DISPLACEMENT APPARATUS WITH MOVABLE CHAMBERS

CROSS-REFERENCE TO RELATED APPLICATION

This application is a continuation-in-part of U.S. application VARIABLE POSITIVE FLUID DISPLACEMENT SYSTEM Ser. No. 07/238,093 Filed Aug. 29, 1988 now U.S. Pat. No. 4,907,950.

BACKGROUND OF THE INVENTION

1. Field of the Invention

This invention relates to positive fluid displacement apparatus of the general type used as superchargers on internal combustion engines and in other applications. More particularly, the invention relates to such apparatus in which two or more pistons are each disposed within a displacement chamber capable of lateral motion to accommodate the circular motion of the piston, that is, each piston chamber is free to move in a direction perpendicular to the direction of travel of the piston.

2. Description of the Related Art

Conventional positive displacement apparatus includes an arrangement in which a stationary displacement chamber contains a piston movable within the chamber. There are many such arrangements developed over many years for application in many different fields and almost all make use of a stationary displacement chamber. Generally the pistons are round in cross section and in almost all cases are driven from a crankshaft through a single connecting rod.

SUMMARY OF THE INVENTION

In contrast to the usual reciprocating motion of a piston along a straight line, the piston in this invention, driven by two widely spaced eccentrics acting as crankpins on a common crankshaft, moves in a circular orbit. As the piston follows its orbital path, it slides inside the chamber causing it to move sideways in a direction perpendicular to the sliding direction of the piston and parallel with the crankshaft. The radial force created by the fluid pressure in the displacement chamber is balanced by a connection to the crankshaft through rotatable and slidable antifriction bearings. Thus as the device operates, the piston follows a rotary path and the displacement chamber follows a lateral reciprocating path along a line perpendicular to the sliding direction of the of the piston inside the chamber and parallel with the crankshaft.

The outer end of the displacement chamber is in intimate sliding contact with a stationary surface. Advantage is taken of the lateral motion of the displacement chamber to operate intake and exhaust ports. During the reciprocating lateral motion of the chamber, port openings located in the end of the chamber are connected alternately to matching intake and exhaust port openings in the adjacent surface, thus providing a reversible valveless control of the fluid to and from the chamber. This allows the apparatus to be used either as a pump or motor without internal modifications. The piston has a relatively large area and moves at lower speeds, relative to displacement, than conventional devices of this type.

The apparatus may have any number of displacement chambers, but as a practical matter, an even number of displacement chambers is to be preferred in almost all applications. When two displacement chambers are used, the two opposing pistons are connected by common structures to each of the two eccentrics or crankpins on the crankshaft. The opposing displacement chambers are also secured together as one piece and are radially connected to the crankshaft. The two pistons follow corresponding circular paths, but one piston will be in the compressive part of its cycle while the other piston will be drawing fluid into the chamber.

In a four piston arrangement, the pistons are secured together as one piece to form two pairs of opposing pistons. Each pair of opposing displacement chambers are secured as one piece and radially connected to the crankshaft. However, the two pairs of chambers are not secured to each other in order to permit independent reciprocating lateral motion in accordance with the lateral component of the piston movements.

The displacement of the apparatus is variable independently of changes in operating speed by variation in the stroke of the pistons. This arrangement is described in connection with another displacement apparatus in the above-mentioned application Ser. No. 07/238,093.

The nutating mass of the pistons and the reciprocating mass of the chambers are dynamically balanced by two counterweights located on opposite sides of and adjacent the eccentric drives.

A most important requirement is the compatibility of the apparatus with the demands of the market place with respect to size, reliability, life etc. It is readily possible using known structures to provide various features of the present invention for theoretical operation—but such structures cannot meet the cost, weight and other limitations inexorably imposed by the market place. The apparatus as described here employs only simple modular components to form the displacement chambers and pistons and to house the driving and throw-adjusting members. The manifolds, mounting structure and crankshaft bearing housings are integrated into two hermaphrodite half shells for easy leakproof assembly and forced internal cooling of the moving components by the fluid being displaced.

BRIEF DESCRIPTION OF THE DRAWING

FIG. 1*a* is a schematic cross-section of a two-piston supercharger with the 12 o'clock piston at bottom dead-center;

FIG. 1*b* is the same as FIG. 1*a* but after the crankshaft has rotated clockwise 90 degrees and the two pistons are at mid-stroke;

FIG. 1*c* is the same as 1*a*, but after the crankshaft has rotated 180 degrees and the 12 o'clock piston is at top dead-center and the 6 o'clock piston is at bottom dead-center;

FIG. 1*d* is the same as FIG. 1*a* but after the crankshaft has rotated clockwise 270 degrees and the pistons are at mid-stroke;

FIG. 2 is a longitudinal section along line 2—2 of FIG. 1*d*;

FIG. 3 is a schematic cross-section of a four cylinder supercharger;

FIG. 4 is a perspective view of an apparatus embodying the invention;

FIG. 16 is a schematic partially-exploded perspective view of the connections of the chambers to the crankshaft; and FIG. 17 is a schematic view of the housing 62*b* viewed from the opposite side.

DESCRIPTION OF THE PREFERRED EMBODIMENTS

For purposes of explanation, the apparatus is considered as a supercharger in which a fluid, such as air, is being pumped, for example, for use in conjunction with an internal combustion engine. It is to be understood, however, that the device can also function as a motor by the application of fluid pressure. In that instance, the functions of certain components, as will be apparent to one skilled in this art, will be reversed from those described here. For example, a port that functions as an exhaust port in the first instance may be regarded as an intake port in the second instance.

In the description, letter suffixes have been used in connection with a generic number designation to indicate similar parts. Because many of the parts are identical in structure, the parts, even though in different locations, may be designated only by the generic number where the suffix is not deemed to be essential to the description.

FIGS. 1*a*–1*d* and 2 are schematic cross-sections of a two piston supercharger only for the purpose of illustrating the nature of the operation. A crankshaft 2 is driven from an external source (not shown) to rotate in a clockwise direction as viewed in FIG. 1*a*. An eccentrically-mounted bushing 4 is secured to and rotates with the shaft 2. Two oppositely disposed pistons 6*a* and 6*c* are connected integrally by a drive structure, generally indicated at 8, that includes a bearing member 10 rotatably mounted on the outer surface of the bushing 4. As the bushing is rotated by the shaft 2, the pistons 6*a* and 6*c* are caused to follow a circular path whose diameter is a function of the degree of eccentricity of the bushing 4.

Figure 2:
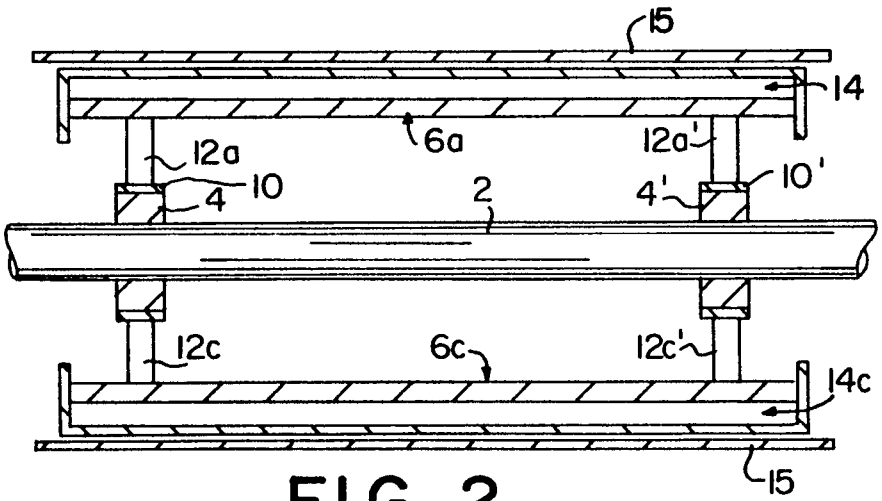

As illustrated by FIG. 2, the piston 6*a* is connected to the eccentric drive at one point by a bridge member 12*a* that forms part of the structure 8. At another point, spaced a considerable distance along the crankshaft 2 from the bridge member 12*a*, the piston 6*a* is connected by a second bridge member 12*a*′ and bearing member 10′ to the second bushing drive member 4′. The bushings 4 and 4′ are maintained at all times with the same degree of eccentricity. As illustrated, the pistons in this example are rectangular in shape although other shapes may be used depending upon the particular application requirements. The opposite piston 6*c* is also supported at spaced points from the eccentric drive mechanisms by bridge members 12*c* and 12*c*′. The two pistons are thus integrally connected and move in unison around their respective orbits.

The piston 6*a* is in sliding engagement with the walls of a displacement chamber 14*a* which is mounted to permit lateral movement perpendicular to the sliding direction of the piston inside the chamber and parallel with the axis of the crankshaft 2. The outer end of the displacement chamber 14*a* is closed and is in sliding engagement with the inner surface of a casing 15 (FIGS. 1*a*–1*d*). The casing 15 is shown as spaced from the end of the chamber 14*a* only for purposes of illustration. Thus as the piston 6*a* follows its orbital path, the piston reciprocates within the displacement chamber 14*a* causing the lateral movement of the displacement chamber. The chamber 14*a* is anchored to the crankshaft, by a mechanism to be described later, in such manner that the chamber is permitted to move laterally in a direction perpendicular to the sliding direction of the piston inside the chamber and parallel with the crankshaft 2, but is prevented from radial movement, parallel with the sliding direction of the piston, with respect to the crankshaft.

Figure 1D:
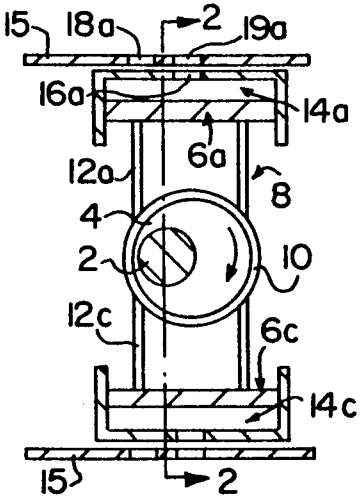
FIGS. 1*a*, 1*b*, 1*c*, 1*d*, 2 and 3 are schematic drawings for the purpose of explaining the principles of the invention.
Figure 1C:
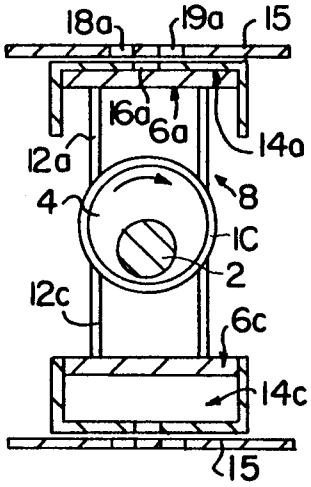
Figure 1B:
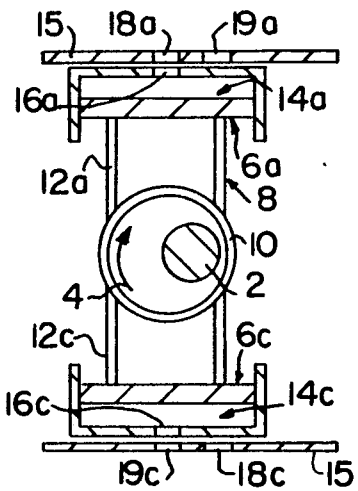
Figure 1A:
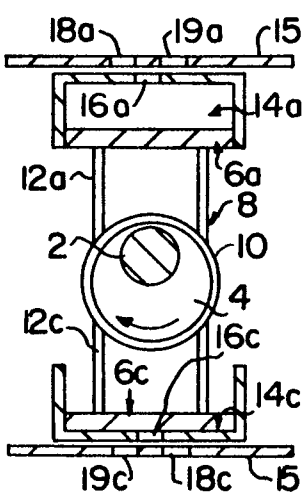

With the piston 6*a* in its midposition, as shown in FIG. 1*b*, clockwise rotation of the shaft 2 causes the piston 6*a* to move upwardly and decrease the capacity of the displacement chamber 14*a*. This same movement withdraws the piston 6*c*, increasing the capacity of the chamber 14*c*. With continued rotation of the shaft 2, as shown in FIGS. 1*c* and 1*d*, the directions of the two pistons are reversed: piston 6*a* moves to increase the capacity of the displacement chamber 14*a* while the capacity of the chamber 14*c* is being decreased by downward movement of the piston 6*c*.

The outer end of the chamber 14*a* is provided with a port opening 16*a*. The casing 15 has an exhaust port opening 18*a* and an intake port opening 19*a*. As the shaft 2 rotates in a clockwise direction from the position shown in FIG. 1*a* to the position shown in FIG. 1*b*, the chamber 14*a* is moved toward the left, as viewed in FIG. 1*b*, to bring the two exhaust port openings 16*a* and 18*a* into alignment. The compressed fluid is thus exhausted from the chamber 14*a* as its capacity is decreased. After the chamber has reached its minimum capacity, as shown in FIG. 1*c*, the piston 6*a* reciprocates in the opposite direction to increase the capacity of the chamber and at the same time the chamber 14*a* is moved toward the right, as viewed in FIG. 1*d*, to bring the port openings 16*a* and 19*a* into alignment. The fluid is thereby enabled to enter through the port opening 16*a* in the piston and 19*a* in the casing 15. The other chamber 14*c* operates in a similar manner with a reversal of the timing of its intake and exhaust ports.

This lateral reciprocating movement of the chambers provides ideal valve timing. Taking either end position of the piston as a zero-degree position, the linear lateral velocity of the chambers is proportional to the cosine of the rotational angle of the crankshaft, while the linear velocity of the pistons in the chambers is proportional to the sine of the angle. When the pistons are at zero linear velocity in the chambers, that is, at the bottom or top of the stroke, the fluid flow is at its minimum and the chambers are at their maximum lateral velocity. Thus, the switching between input and exhaust port connections takes place in the minimum amount of time. Conversely when the pistons are in their mid-positions and moving at maximum linear velocity within the chamber, when the fluid flow is at its maximum, either the exhaust port or the intake port is fully opened and will remain so for the longest period of time because the lateral velocity of the chamber is at a minimum. Minimum flow restriction is thus assured.

Figure 3:
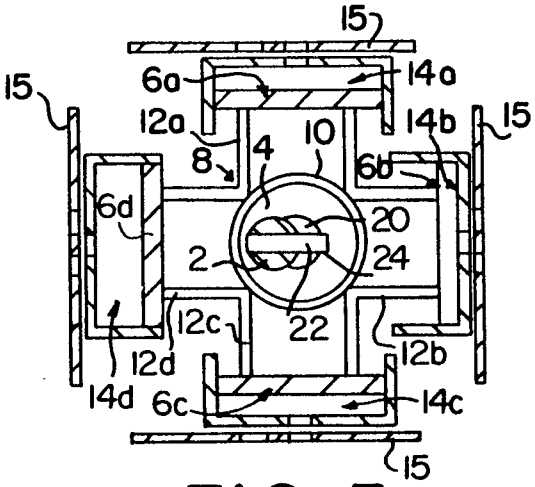

FIG. 3 shows a similar displacement apparatus with four pistons. In this example, the four pistons 6a, 6b, 6c and 6d are joined together as a single structure and are moved in unison by the bushings 4. The pistons are positioned angularly around the crankshaft 2 at 90 degree intervals. This spacing produces the different timing for the individual chambers. When the piston 6a is at the top of its stroke, the piston 6c is at the bottom of its stroke and the other two pistons 6b and 6d are in their mid-positions although moving in opposite directions relative to their respective chambers. All four pistons are joined into an integral drive structure, generally indicated at 8, through the bridge members 12a, 12b, 12c and 12d and the bearing member 10.

The rate of displacement is varied by varying the eccentricity of the bushings 4 and thus the length of the piston strokes. FIG. 3 illustrates schematically the general method that is employed to change the eccentricity. The crankshaft 2 is positioned within an elongated opening 20 that extends transversely through the bushing 4. An actuating pin 22 extends through the crankshaft 2 and engages a keyway 24 at the end of the opening 20. This actuating pin provides the driving force for the bushing 4.

The actuating pin 22 is capable of relative adjustment transversely through the crankshaft 2 to vary the relative radial positions of the crankshaft 2 and the bushing member 4. In FIG. 3, the crankshaft 2 is positioned at the end of the opening 20 in the bushing 4 and the piston stroke is at its maximum. When the bushing 4 is moved by the actuating pin 22 until the crankshaft is at the center of the bushing 4 there is no movement of the pistons and consequently no displacement of the fluid. The adjustment of the actuating pin 22 is made by means of a push-rod mounted within the crankshaft 2 and will be described later in connection with the more detailed embodiment. An identical adjustable eccentric drive is positioned to support each end of the pistons.

The chambers 14a and 14c are secured together as one piece by a mechanical structure that is connected to the crankshaft 2 in such manner as to permit lateral movement of the chambers in a direction perpendicular to the sliding direction of the piston inside the chamber and parallel with the axis of the crankshaft, but which prevents movement in a direction parallel with the sliding direction of the pistons. The other pair of chambers 14b and 14d are joined to each other and are also radially and slidably secured to the crankshaft 2. By anchoring the chambers to the crankshaft, the radial loads created by the fluid pressure in the chambers are resisted by the counterforce of the crankshaft 2 thus limiting the pressure between the chambers and the adjacent walls of the casing 15. In practice, a wear resistant bearing surface is positioned between the chamber ends and the casing 15. The unit is dynamically balanced by two counterweights with adjustable eccentricities to be described later.

The constructional details are illustrated by FIGS. 4–16 for a four-piston unit. As shown in FIG. 4, the supercharger, generally indicated at 100, is driven by a crankshaft 102 that is rotated by any desired external force. Air is drawn into the unit through supply ports 125 and 125', located on the side of the unit, and is exhausted through a discharge port 128. The displacement rate of the unit is controlled by the linear position of a control rod, generally indicated at 132, that extends within the crankshaft 102. When the rod 132 is moved in one direction, the volume of air being pumped progressively increases to a maximum. When the rod is moved in the opposite direction, the volume of air being pumped progressively decreases to substantially zero.

As shown in FIG. 4, a housing, generally indicated at 62, consists of two hermaphrodite half-shells 62a and 62b (both male and female) bolted together. These housing shells 62a and 62b are clamped around and support two crankshaft bearings 63 and 63' (see also FIG. 5) and provide the necessary manifolding to connect the external port openings in the housing to the internal displacement chambers. Structural and tightness integrity are maintained by a tongue and groove connection 80 (FIG. 8) between the two half shells. Six studs 81 are provided to attach the apparatus to the fresh air intake and engine intake manifolds (not shown). Eight threaded bosses 82 (FIG. 4) are provided for physical mounting of the apparatus.

Figure 7:
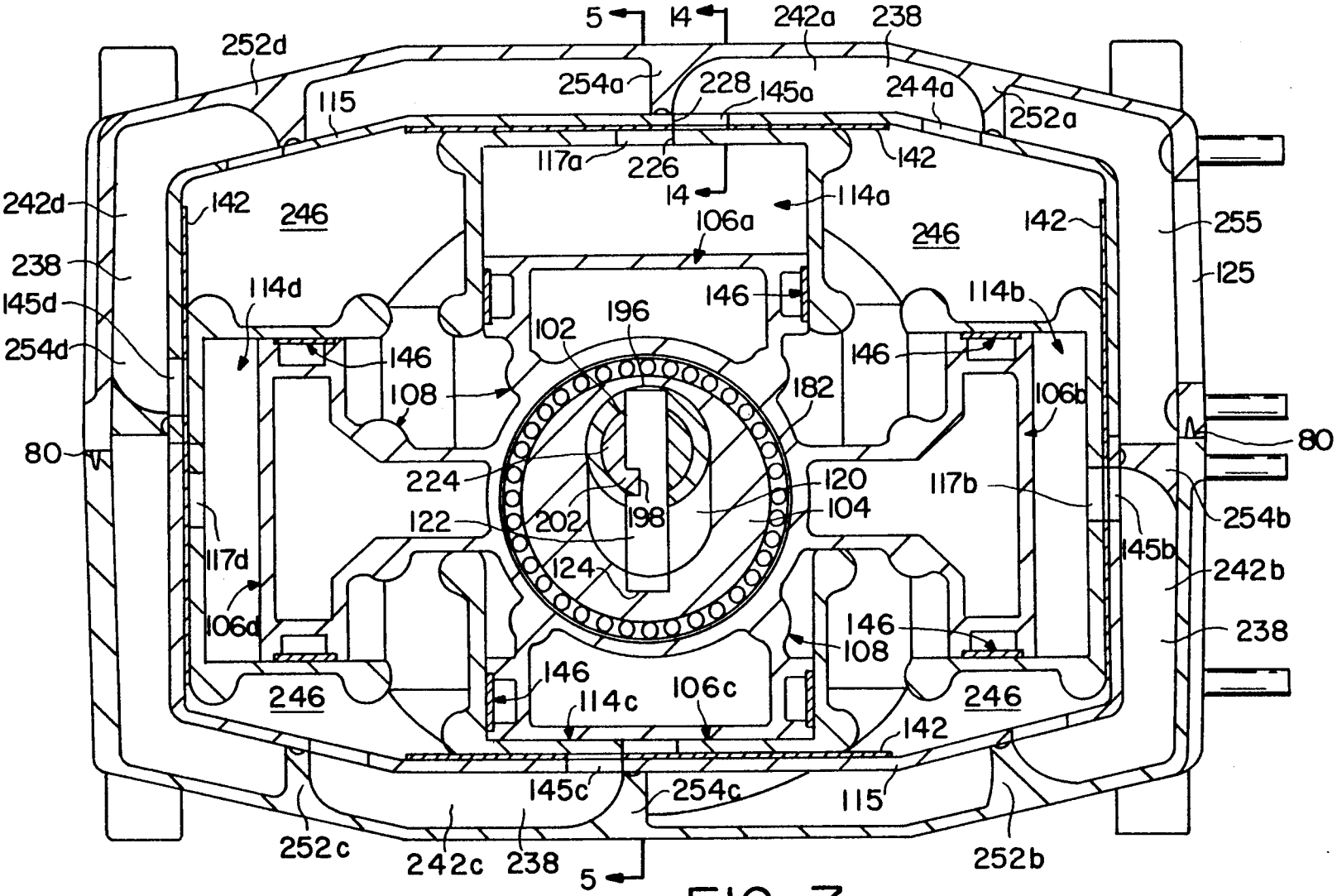
FIG. 7 is a transverse cross-section along line 7—7 of FIG. 5.

As shown in FIG. 7, four pistons 106a, 106b 106c and 106d are positioned at equal angles around the crankshaft 102. The four pistons form part of an integral structure, generally indicated at 108, which is closed at the ends by plates 134L and 134R (FIG. 5) that are securely fastened to the structure 108. The four pistons 106a, 106b, 106c and 106d (FIG. 8) extend respectively into four displacement chambers, generally indicated at 114a, 114b, 114c, and 114d. The pistons are slidably mounted inside the respective displacement chambers.

Figure 5:
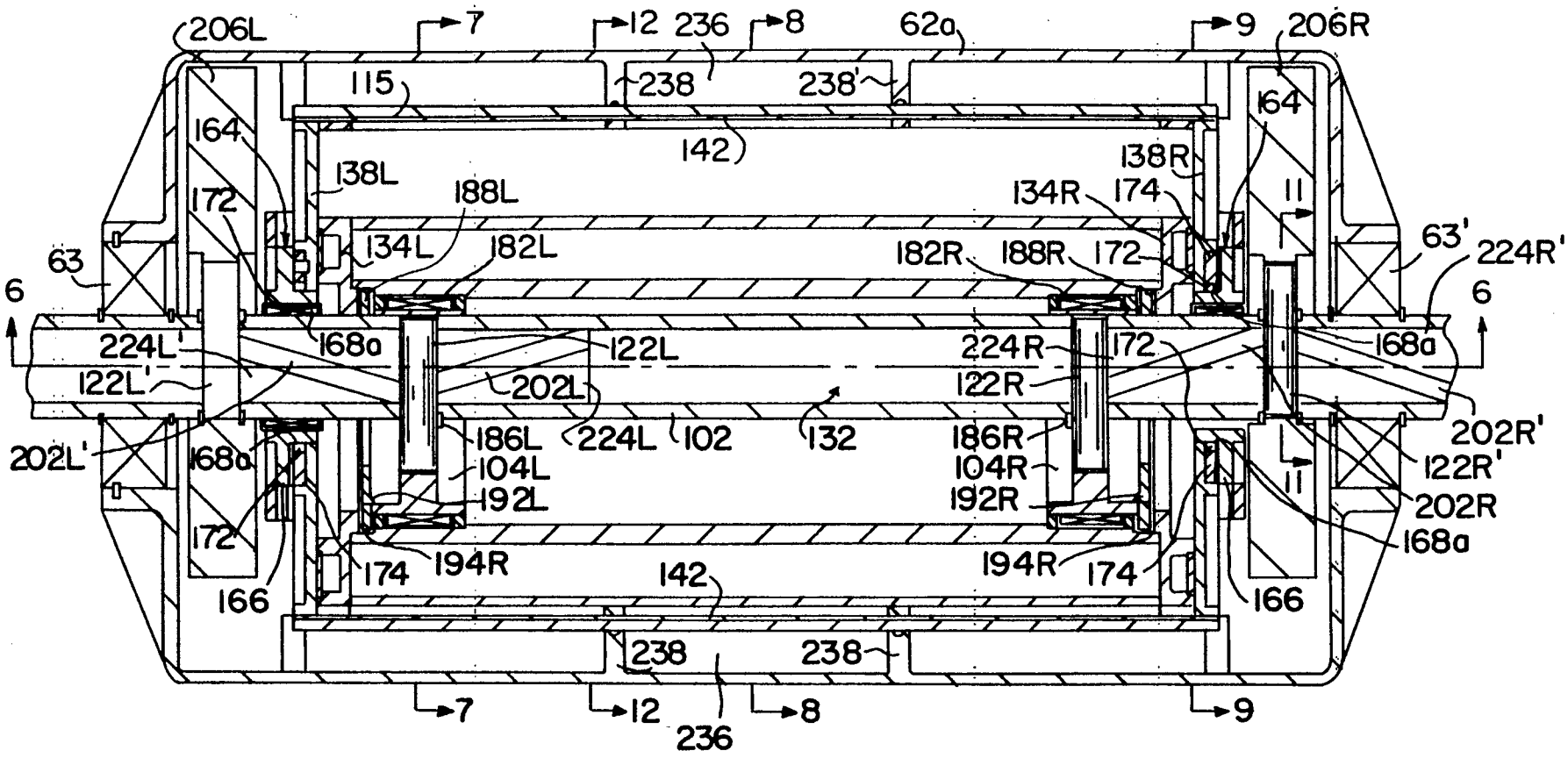
FIG. 5 is a longitudinal cross-section generally along line 5—5 of FIG. 4 and more specifically along line 5—5 of FIG. 7.
Figure 6:
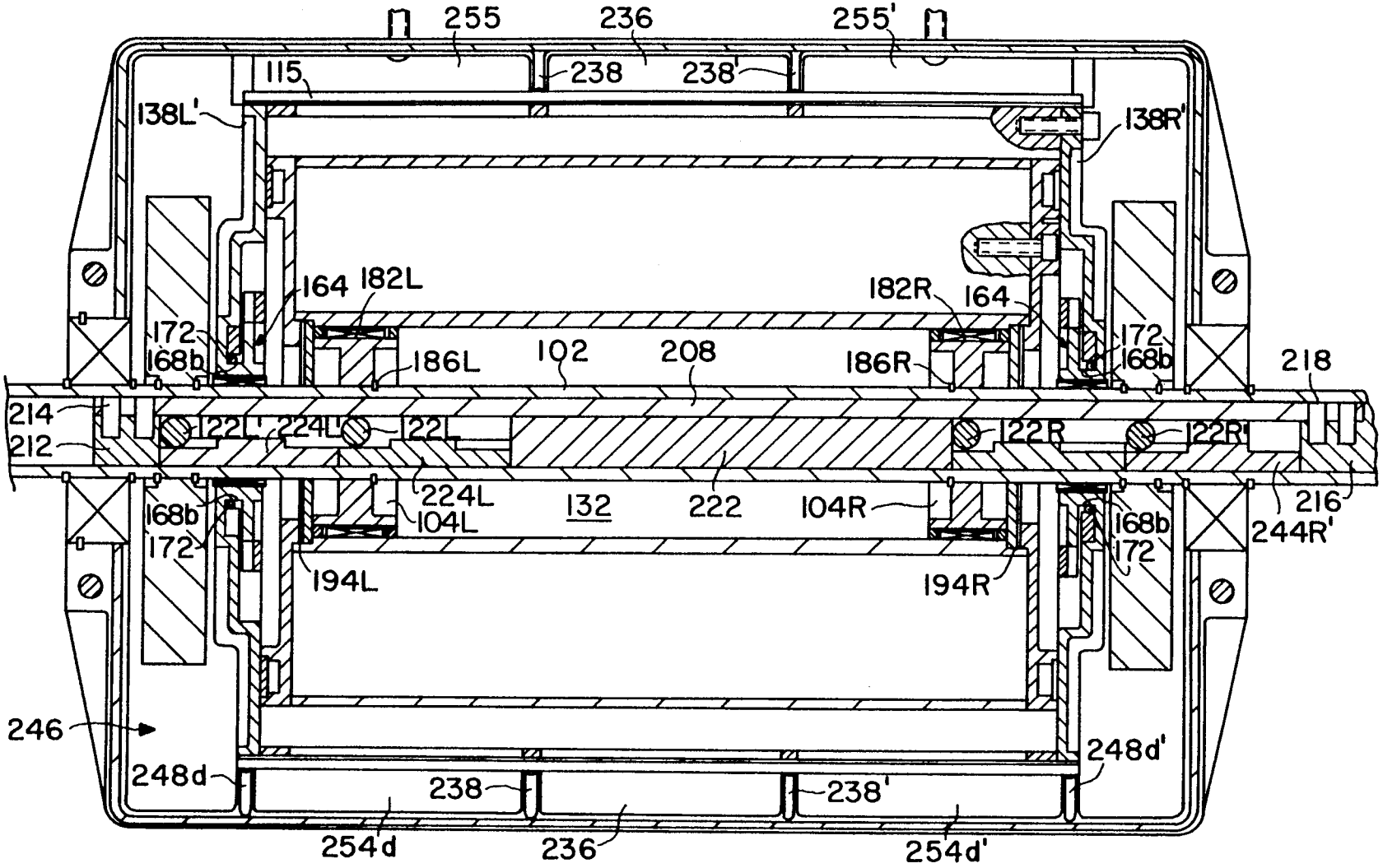
FIG. 6 is a longitudinal cross-section along line 6—6 of FIG. 5.

Each displacement chamber consists of a longitudinal channel closed on one end and on four sides. The channels of the chambers 114a and 114c are closed at the ends by end plates 138L and 138R (FIG. 5), and the channels of the chambers 114b and 114d are closed by end plates 138L' and 138R' (FIG. 6).

Figure 8:
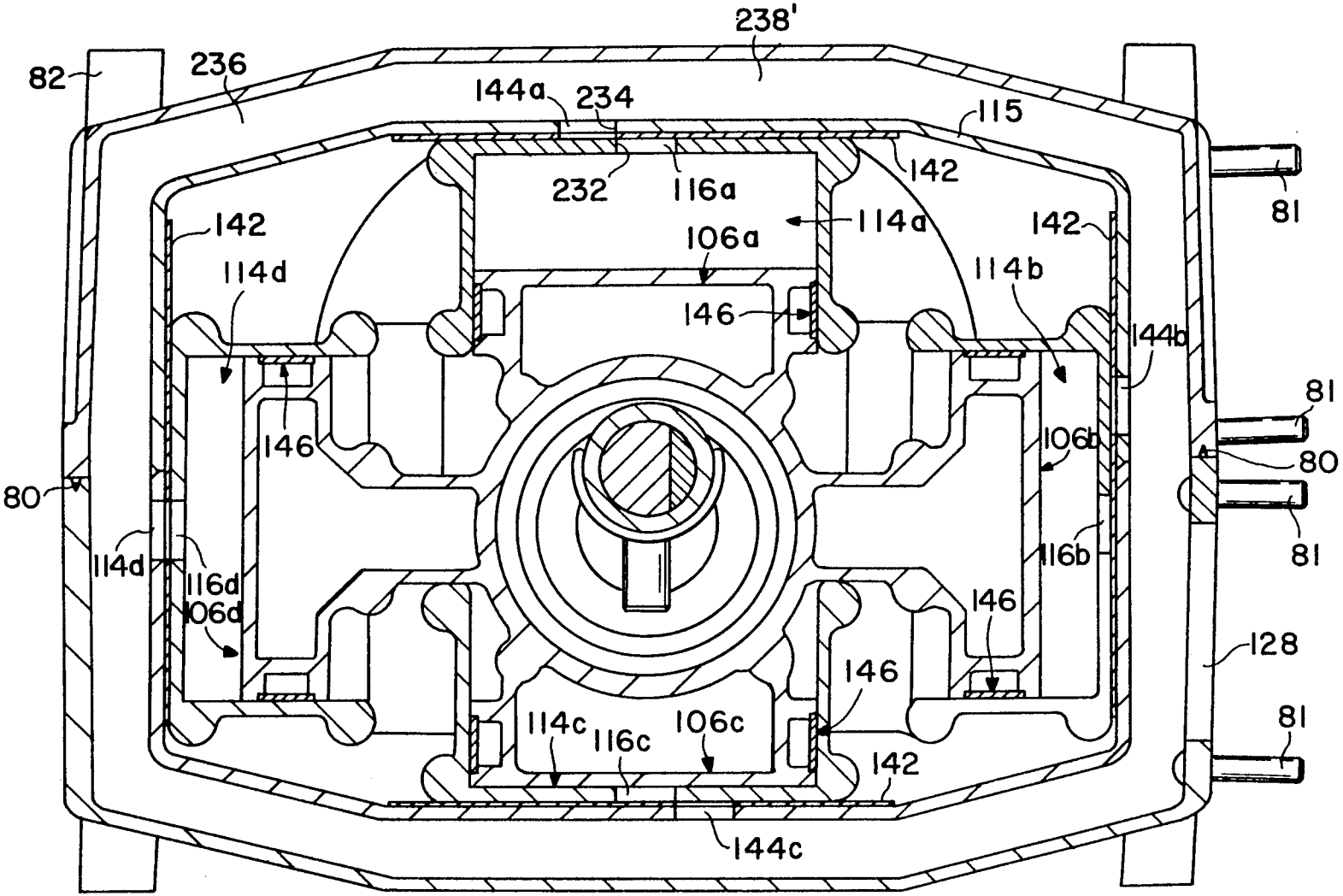
FIG. 8 is a transverse cross-section generally along line 8—8 of FIG. 4 and more specifically along line 8—8 of FIG. 5.

The outer end of each displacement chamber is provided with one exhaust port opening and two intake port openings. As shown in FIGS. 7 and 8, the displacement chamber 114a has an exhaust port opening 116a and two intake port openings 117a. The chamber 114c has an exhaust port opening 116c and two intake port openings 117c. FIG. 8 shows the exhaust port openings 116a, 116b, 116c and 116d for the chambers 114a, 114b, 114c and 114d, respectively. FIG. 7 shows the intake port openings 117a, 117b, 117c and 117d for the chambers 114a, 114b, 114c and 114d, respectively. In each chamber all of the intake and exhaust ports are located approximately on the same longitudinal axis along the center of the outer end of the chamber.

As shown in FIG. 8, the outer end surface of each chamber slidably engages a layer 142 of self lubricating bearing material that is secured to the inner surface of a casing 115. The casing 115 which, encloses all of the displacement chambers, has four exhaust port openings 144a, 144b, 144c and 144d and eight intake port openings 145*a*, 145*b*, 145*c* and 145*d* (FIG. 7). The layer 142 of bearing material has ports that match the ports in the casing 115.

Figure 10:
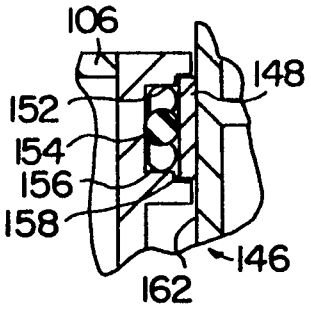
FIG. 10 is a partial cross-section of a typical piston groove and ring arrangement.
Figure 14:
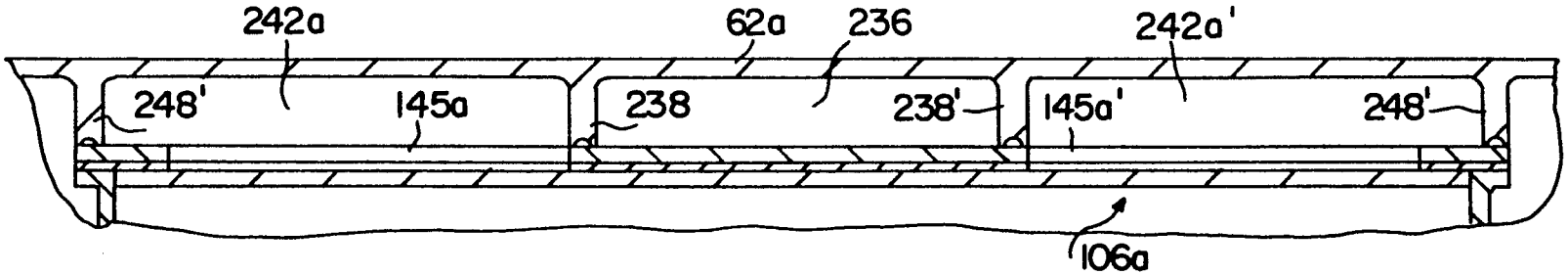
FIG. 14 is a partial longitudinal cross-section along line 8—8 of FIG. 7.

A sliding seal, generally indicated at 146 (FIG. 7), is provided around the periphery of each piston. FIG. 10 shows a cross sectional view of the construction of the seals. A piston ring 148 that extends around the periphery of the piston is maintained in contact with the wall of the displacement chamber by a spring 152. Sealing of the piston is insured by an elastomeric ring 154 positioned in a groove 156. A step 158 in the groove 156 provides a rigid stop for the ring 148 so that in the event of unusual lateral forces, a minimum clearance is always maintained between the edge surfaces of the piston 106 and the walls 162 of the displacement chamber. The force-deflection curve of the spring 152 is non-linear and becomes increasingly stiffer as the deflection increases. This seal is described more fully in the previous application identified above. For the purposes of this invention, however, any suitable sealing means may be employed.

Figure 9:
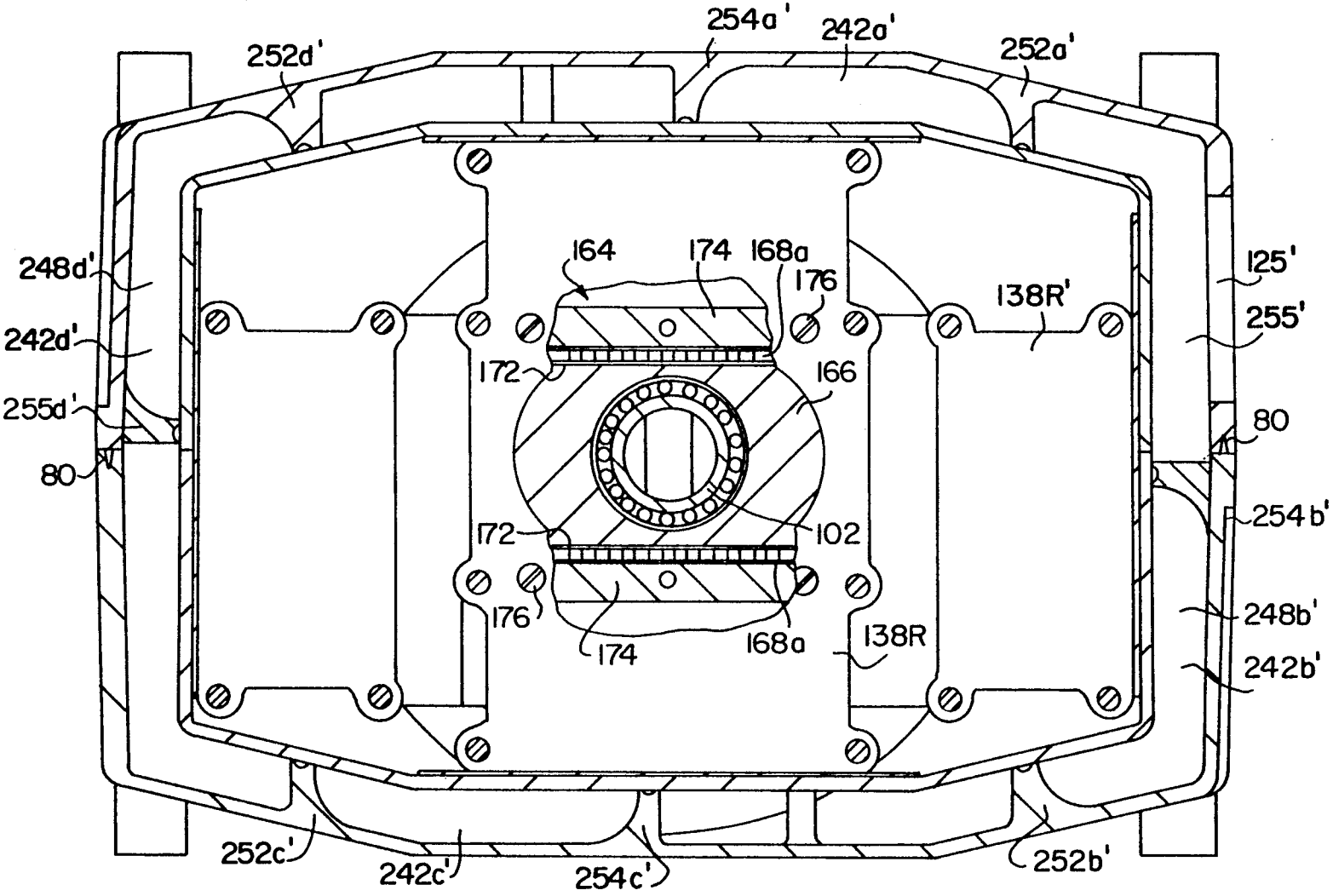
FIG. 9 is a transverse cross-section along line 9—9 of FIG. 5.

The pressure inside the displacement chambers caused by the movement of the pistons would create substantial pressure between the end of the chamber and the bearing surface 142. However, as shown by FIGS. 5, 6, 9 and schematic FIGS. 15 and 16, the paired displacement chambers 114*a* and 114*c*, and 114*b* and 114*d*, are connected to the crankshaft 102 in such a way that the radial loads caused by the pressure in the chambers as the fluid is compressed by the pistons is carried by the crankshaft 102 by way of two rotary/linear antifriction bearings, generally indicated at 164. (See FIGS. 5 and 6 for positioning and FIG. 9 for details of construction.) By rotary/linear bearing is meant a bearing that permits the structure attached to it to move in one direction perpendicular to the rotary axis of the bearing and which restricts movement in other directions. This bearing (FIGS. 5 and 9) consists of an inner element 166 and has a pair of parallel raceways 168*a* that receive rollers 172. Another pair of parallel raceways 168*b* (FIG. 6) are positioned at right angles to the raceways 168. The same bearing assemblies 164 that are secured to the chambers 114*a* and 114*c* are secured to the chambers 114*b* and 114*d*.

As shown by FIGS. 5 and 9, a pair of retainer elements 174 are secured to each of the end plates 138R and 138L by fasteners 176 (FIG. 9). The end plates 138L and 138R ride on the raceways 168*a* and the end plates 138L' and 138R' ride on the raceways 168*b*, both by way of the rollers 172.

FIGS. 5 and 6 illustrate the drive connection of the pistons 106*a*, 106*b*, 106*c* and 106*d* to the crankshaft 102. The structural member 108 that is integral with all four pistons houses two antifriction bearings 182L and 182R, each with conventional seals. Two eccentrically mounted bushings 104L and 104R, which act as two widely-spaced crank pins, are rotatably mounted inside the bearings 182L and 182R. This bushing and bearing structure is movable radially with respect to the crankshaft 102 and is prevented from axial movement by two retaining rings 186L and 186R. A pair of thrust washers 188L and 188R, made of suitable bearing material with self-lubricating properties, are located on and driven by the bushings 104 by means of tabs 192L and 192R (FIG. 5). The thrust washers 188 are in sliding contact with the end plates 134L and 134R through wear washers 194L and 194R.

The mechanism for varying the eccentricity of the piston drives is described in detail in the earlier application identified above. As shown in FIGS. 5, 6 and 7 each bushing 104 is provided with an elongated opening 120 (FIG. 7) that allows the bushing 104 to move radially with respect to the crankshaft 102 from a near concentric position to a maximum extended or "throw" position. An actuating pin 122 is radially and slidably mounted through the crankshaft 102 and has one end 196 resting on the inner curved surface of one end of the opening 120 and the other end engaging a keyway 124 at the opposite end of the opening 120.

The actuating pin 122 has an external recess 198 that is slanted with respect to its longitudinal axis. The control rod 132, which extends longitudinally within the crankshaft 102 (see also FIG. 4), has a projection 202 that is slanted to correspond to the recess 198 so that the projection 202 is capable of sliding freely within the hollow crankshaft. Thus, as the control rod 132 is moved axially of the crankshaft 102, it displaces the eccentric bushing 104 radially with respect to the crankshaft. Thus, the projection 202 on the control rod 132 extends at an angle relative to the axis of the crankshaft 102 so that the elevation of the projection 202, at a fixed point along the axis of the crankshaft, moves transversely to the axis of the crankshaft. In the position shown in FIG. 7, the throw of the eccentrically-mounted bushing 104 is at maximum, that is in a position to provide maximum piston excursion. If the control rod 132 were to be moved to the left from the position shown in FIGS. 5 and 6, the throw of the bushing 104 would be reduced. It will be clear that the bushing 104' is incorporated into an identical structure to produce simultaneous stroke adjustment of each piston support.

As viewed in FIG. 5, a leftward movement of the control rod 132 would cause the projection 202L to move the actuating pin 122L upwardly, decreasing the piston stroke. Simultaneously, the projection 202R would move the actuating pin 122R upwardly to similarly adjust the stroke of the piston supports at the opposite ends of the pistons.

Figure 11:
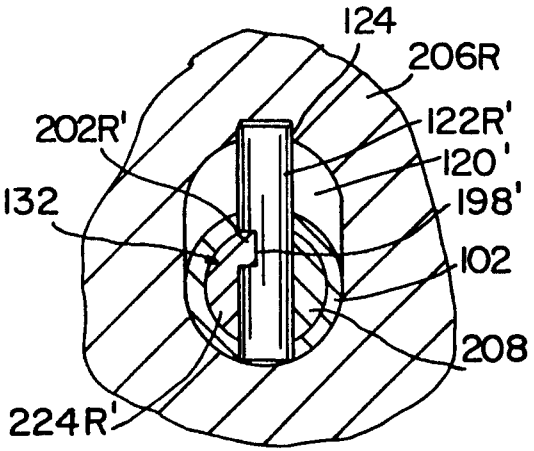
FIG. 11 is a partial cross-section along line 11—11 of FIG. 5.

Operation of the structure as described would result in a significant dynamic unbalance. To dynamically balance the mass of the nutating pistons 106*a*, 106*b*, 106*c* and 106*d* with the bearings 182 and seals 184, the rotating eccentrically mounted bushings 104, the pins 122 and thrust washers 192, and the reciprocating chambers 114*a*, 114*b*, 114*c* and 114*d*, two disc-shaped counterweights 206L and 206R (FIG. 5) are mounted on the crankshaft 102 at opposite ends of the apparatus adjacent the chambers 114*a*, 114*b*, 114*c* and 114*d* and are adjustable radially with respect to the crankshaft. This adjustment is accomplished through the control rod 132 in a manner similar to, and simultaneously with, the adjustment of the piston stroke. As shown in FIG. 11, the counterweight 206 has an elongated opening 120' in which is positioned an actuating pin 122' radially adjustable with respect to and slidable through the crankshaft 102 with one end abutting the inner curved surface of the opening 120', and the other end engaging a keyway 124' at the opposite end of the elongated opening 120' and resting against the surface of the keyway. The actuating pin 122R' has an external recess 198' that is slanted with respect to its longitudinal axis. An equally slanted projection 202L' (FIG. 5) is actuated by the control rod 132 that is freely slidable within the crankshaft 102. When the control rod 132 is moved axially of the crankshaft, the elevation of the projection 202L', at a fixed point along the crankshaft, moves transversely to the axis of the crankshaft. In the position shown in FIG. 11, the counterweight 206 is at maximum throw, that is, in position to provide maximum balancing moment.

Theoretically, the control rod structure could consist of a single length of rod with the appropriate slanted projections on it. However, for reasons of manufacture and assembly, it is preferable that the control rod be divided into separate segments as described. The control rod 132 (FIG. 6) comprises five sections two control wedge segments 224L' and 224L, a spacer 222, and two control wedge segments 224R and 224R'. The projections 202L' and 202L are formed on the segments 224L and 224L', respectively. The projections 202R and 202R' are formed on the segments 224R and 224R', respectively. The control wedge segments 224L and 224L' are mirror images of the wedge control segments 224R and 224R'. The actuating pins 122L' and 122L are mirror images of the actuating pins 122R' and 122R. If the control rod 132 were to be moved to the left of the position shown in FIG. 5, the throw of bushings 104L and 104R and the counterweights 206L and 206R would be simultaneously reduced that same distance from the axis of the crankshaft 102, thus maintaining the dynamic balancing of the rotating and reciprocating masses.

As shown in FIG. 6, the control rod 132 includes a tension member 208, freely slidable within the crankshaft 102. One end of the tension member 208 is permanently secured to a block 212 by means of pins 214 or other suitable fastening means. The other end of the tension member 208 is secured to an external element 216, that forms the end portion of the control rod 132, by demountable means such as pins or screws 218. The spacer element 222 abuts the inner ends of the control wedge segments 224L and 224R. The outer ends of the wedges 224L and 224R respectively abut the ends of control wedges 224L' and 224R'. On the left, as viewed in FIG. 6, the outer end of the control wedge 224L' abuts the inner surface of the block 212. On the other side, the outer end of the control wedge 224R' abuts the inner end of the external element 216. Adjustment of the control rod 132 toward the left, as viewed in FIG. 6, will move the control wedge 224R', the control wedge 224R, the spacer 222, the control wedge 224L and the control wedge 224L' simultaneously an equal distance toward the left from the position shown. Adjustment of the control rod toward the right will bring all of the control wedges and the spacer element back to their original positions as shown.

During assembly, the tension member 208 is detached from the external element 216 and then slid from right to left into the crankshaft 102 to the position shown. Starting from the left and progressing toward the right, the first actuating pin 122L' is slid radially through the crankshaft to the position shown. The wedge segment 224L' is then slid axially, through the hollow of the crankshaft, with its projection 202L sliding inside the recess 198L' of the actuating pin 122L'. The actuating pin 122L is slid radially through the crankshaft and the control wedge 224L and the spacer 222 are slid axially into position. The actuating pin 122R, the control wedge 224R, the actuating pin 122R' and the control wedge 224R' are then assembled in the same manner. The external element 216 is then fastened to the tension member 208. The external element 216 is then connected to any desired linear push-pull actuator (not shown).

The relative positions of the port openings at the ends of the displacement chambers to the port openings in the casing 115 are critical to insure proper valving. It is affected by the direction of the rotation of the crankshaft 102. In FIGS. 7 and 8, the crankshaft is assumed to be rotating in a clockwise direction and the bushings 104 are shown in the maximum throw position. If the crankshaft 102 were to rotate in the counter-clockwise direction, the relative positions of the intake and exhaust ports in the chambers and the casing 115 would need to be mirror images from the positions shown in FIGS. 7, 8, 11 and 13.

FIGS. 7 and 8 are similar cross-sectional views but at different locations to illustrate the operation of both the intake and exhaust ports. As shown in FIG. 7, the bushing 104L (and also bushing 104R) are at the maximum-throw, six o'clock position. The piston **106*a* is at its "bottom dead center" in chamber 114*a*, which is at its center position laterally with respect to the axis of the crankshaft 102, and at maximum displacement. The intake port openings 117*a* are sealed by the bearing material 142 supported by the casing 115. The intake port openings 145*a* in the casing 115 are positioned in such a way with respect to the openings 117*a* that the right edges 226 of port openings 117*a* are in coincidence with the left edges 228 of the openings 145*a* which are sealed by the end of the chamber 114*a***.

As shown in FIG. 8, at the same rotary position of the crankshaft 2, the exhaust port opening **116*a* is sealed by the bearing material 142 and casing 115. The exhaust port opening 144*a* in the casing 115 is positioned with respect to the exhaust port opening 116*a* so that the left edge 232 of the exhaust port opening 116*a*, is in coincidence with the right edge 234 of the exhaust port opening 144*a* which is sealed by the end of the chamber 114*a***.

The piston **106*b* is at mid-stroke in chamber 114*b*. As viewed in both FIGS. 7 and 8, this chamber has moved downward to its maximum lateral position. The displacement is increasing and fluid is entering through the intake ports 117*b* and 145*b* (FIG. 7), which are in coincidence. As shown in FIG. 8, the exhaust port openings 116*b* and 144*b*** are sealed.

The piston **106*c* is at "top dead center" in the chamber 114*c* which is laterally in its center position. The displacement is at its minimum. The intake ports 117*c* and 145*c* (FIG. 7) are sealed and in the same positions with respect to each other as are the intake ports 117*a* and 145*a*. As shown in FIG. 8, the exhaust port openings 116*c* and 144*c* are sealed in the same position with respect to each other as the exhaust port openings 116*a* and 144*a***.

The piston **106*d* is at its mid-stroke position in the chamber 114*d* which has moved laterally (downwardly as viewed in FIG. 7) to its maximum position. The displacement is decreasing and the intake ports 117*d* and 145*d* are sealed. As shown in FIG. 8, the fluid is being discharged through exhaust port openings 116*d* and 144*d*** which are in coincidence.

Figure 12:
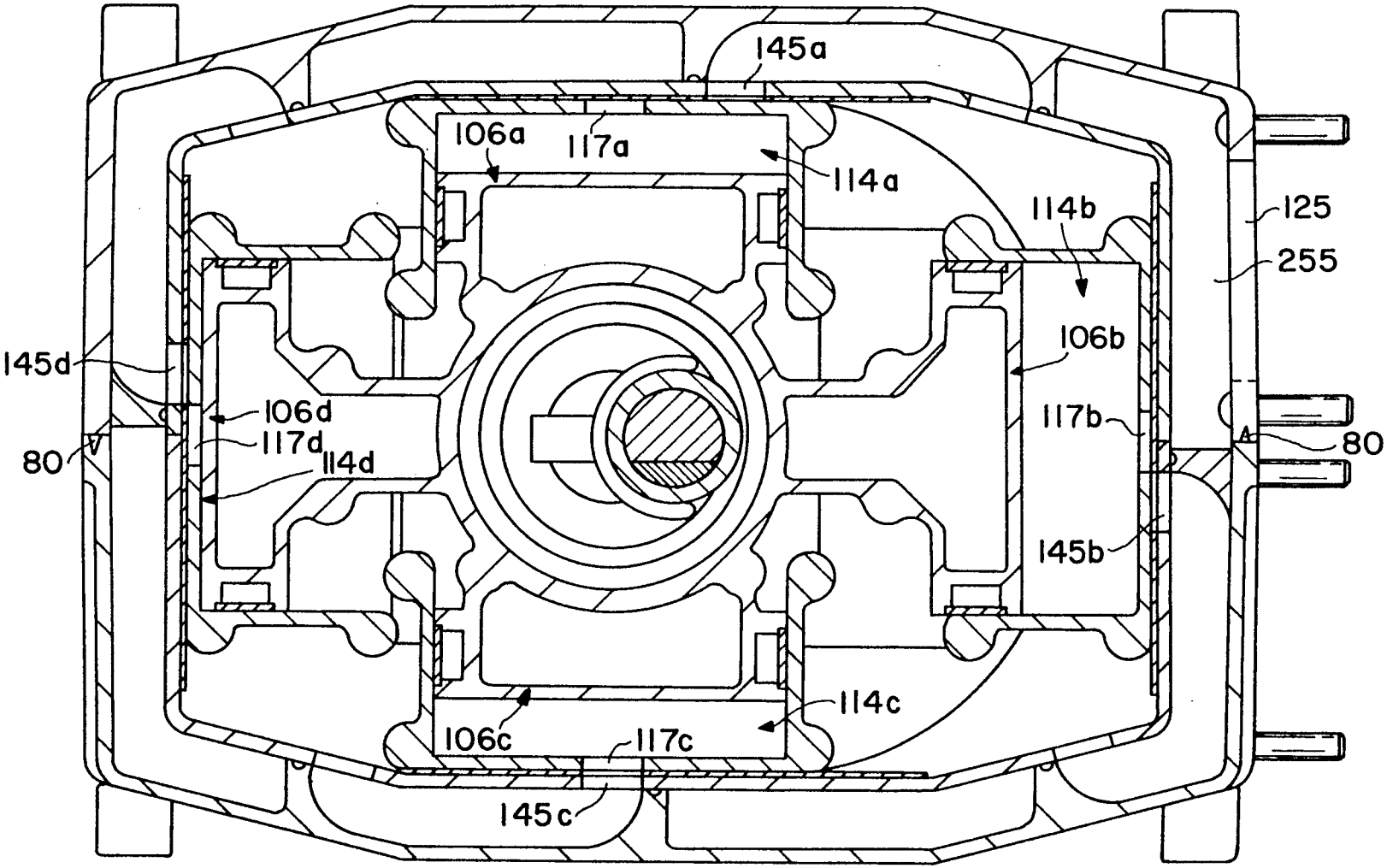
FIG. 12 is a cross-section along line 12—12 of FIG. 5 with the crankshaft rotated clockwise 90 degrees from the position shown in FIG. 7.
Figure 13:
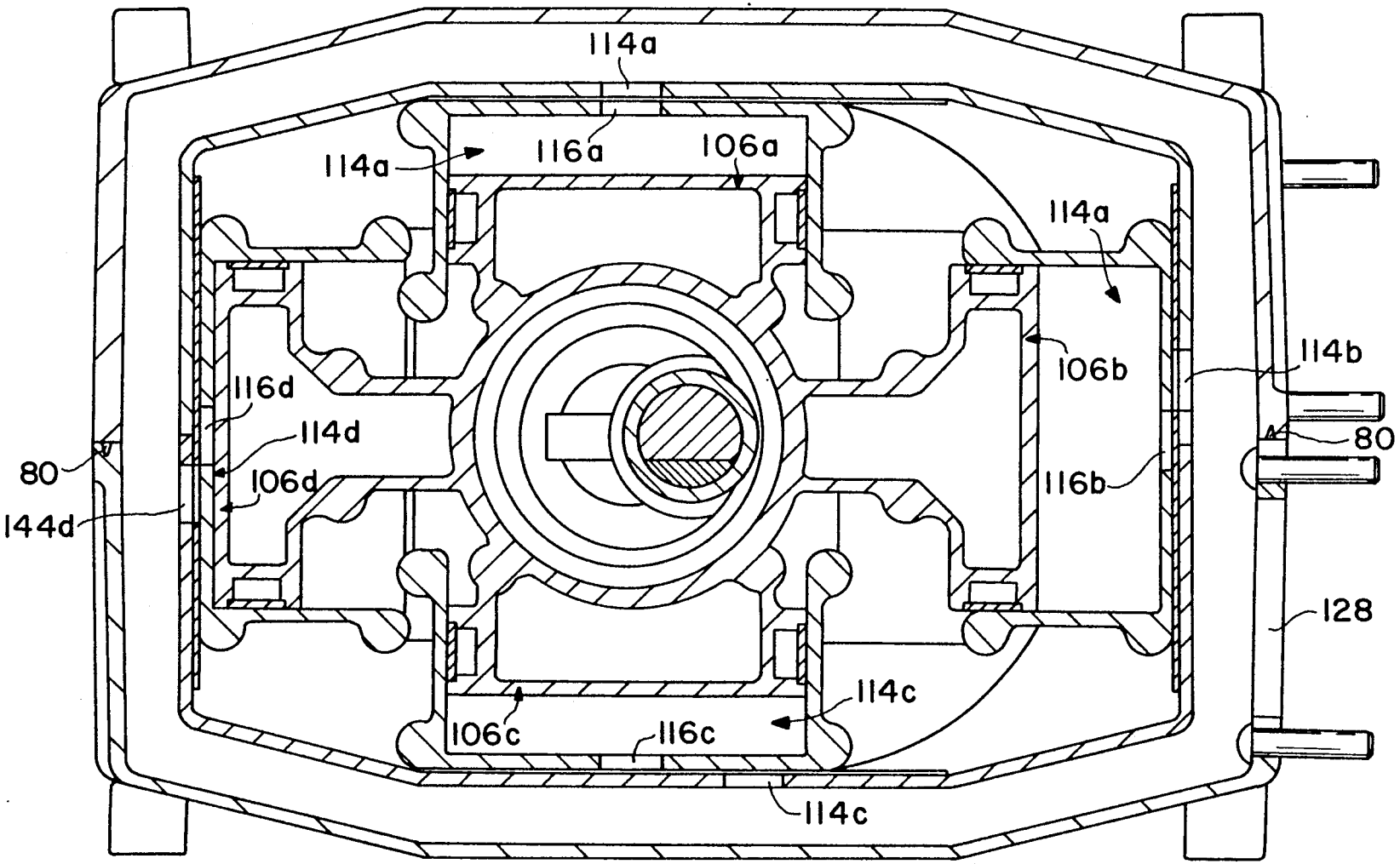
FIG. 13 is a cross-sectional view the same as that of FIG. 8 with the crankshaft rotated clockwise 90 degrees from the position shown in FIG. 8.
Figure 15:
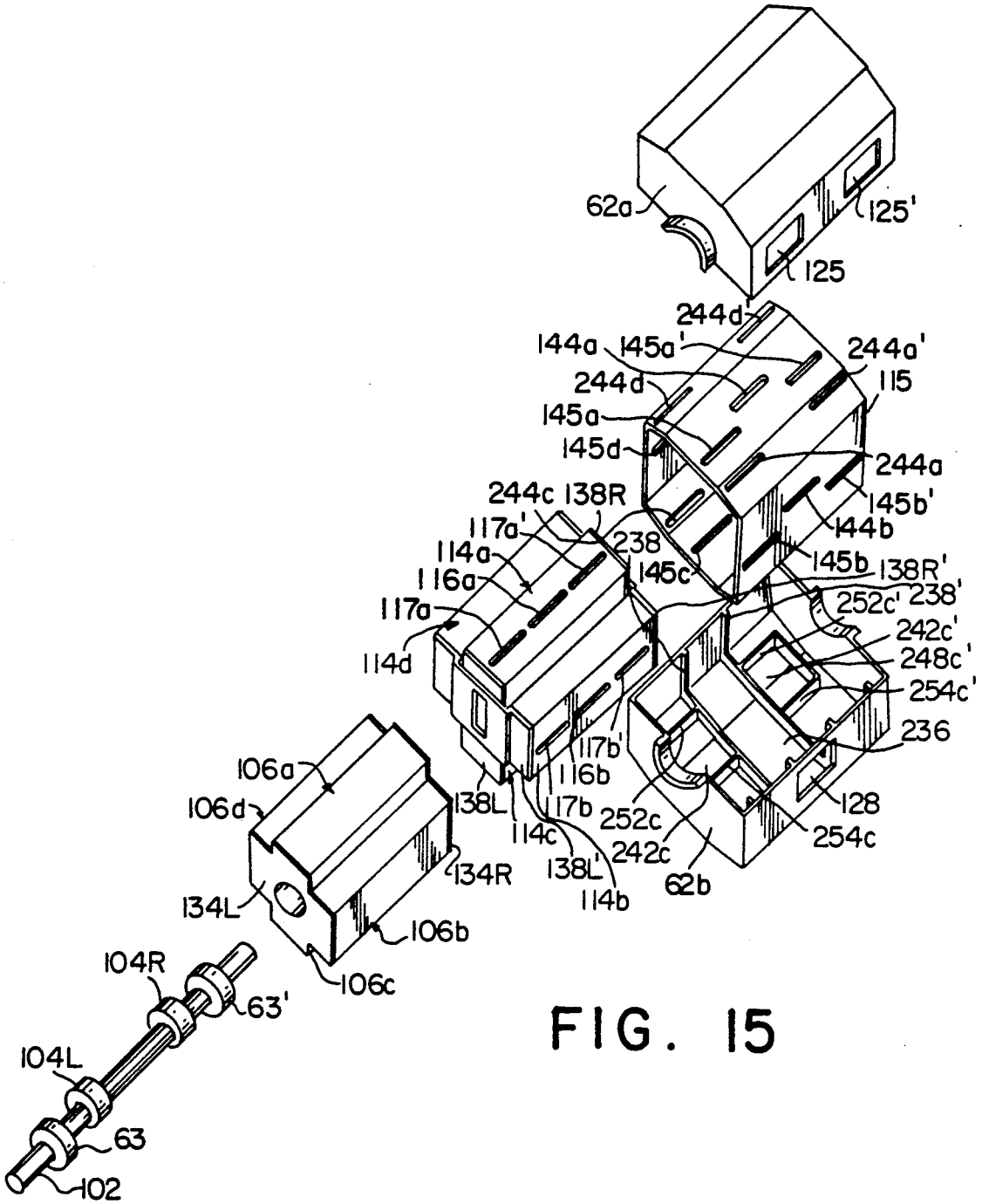
FIG. 15 is a partially-exploded schematic perspective view of the supercharger.

FIGS. 12 and 13 are similar cross-sectional views but at different points. In these views, the crankshaft has been rotated ninety degrees from the position shown in FIGS. 7 and 8. The piston **106*a* is at mid-position in the chamber 114*a* which is at its maximum left lateral position as viewed in FIG. 12. The displacement is decreasing and the intake port openings 117*a* and 145*a* are sealed. As shown in FIG. 13, the fluid is being discharged through the exhaust port openings 116***a* and 144*a* which are in coincidence.

The piston 106*b* is at its "bottom dead center" position in the chamber 114*b* which is in its central lateral position. The displacement is at its maximum. The intake port openings 117*b* and 145*b* are sealed (FIG. 12) and in the same positions with respect to each other as the intake port openings 117*a* and 145*a* of FIG. 7. The exhaust port openings 116*b* and 144*b* (FIG. 13) are sealed and in the same relative positions as the exhaust port openings 116*c* and 144*c* in FIG. 8.

The piston 106*c* is at mid-stroke in the chamber 114*c* which is at its maximum lateral left position as viewed in FIG. 12. The displacement is increasing and the fluid is drawn inside the chamber through the intake port openings 117*c* and 145*c* which are in coincidence. As shown in FIG. 13, the exhaust port openings 116*c* and 144*c* are sealed.

The piston 106*d* is at its "top dead center" position in the chamber 114*d* which is at its central lateral position. The displacement is at its minimum and the intake port openings 117*d* and 145*d* (FIG. 12) are sealed and in the same relative positions as the intake port openings 117*c* and 145*c* in FIG. 7. The exhaust ports 116*d* and 144*d* (FIG. 13) are sealed and in the same relative positions as the exhaust port openings 116*c* and 144*c* in FIG. 8.

To provide maximum cooling of the apparatus, the incoming fluid is forced to flow around the internal moving parts before entering the displacement chambers. As shown in FIGS. 5, 6 15, and 17, a high pressure annular cavity 236 approximately equal in length to the length of the exhaust openings 144*a*, 144*b*, 144*c* and 144*d* in casing 115, which are in turn approximately equal in length to the exhaust openings 116*a*, 116*b*, 116*c*, and 116*d*, respectively, of the chambers 114*a*, 114*b*, 114*c* and 114*d*. Two partitions 238 and 238', which are secured to or integral with the shells 62*a* and 62*b*, form the annular cavity 236 around the casing 115. A continuous gasket material (not shown) between partitions 238 and casing 115 seals the cavity 236 from the adjacent low pressure areas. The cavity 236 connects to the discharge port 128 in the shell 62*b*.

As shown in FIGS. 7, 9, 14, 15 and 17, four aligned cavities 242*a*, 242*b*, 242*c*, and 242*d* located on the left side of the annular cavity 236, and four aligned cavities 242*a'* 242*b'*, 242*c'* and 242*d'* located on the right side of the annular cavity 236 (as seen from the side of supply and discharge ports 125 and 128), respectively connect the casing 115 intake port openings 145*a*, 145*b*, 145*c*, 145*d*, 145*a'*, 145*b'*, 145*c'* and 145*d'* to casing port openings 244*a*, 244*b*, 244*c*, 244*d*, 244*a'*, 244*b'*, 244*c'* and 244*d'*. The last eight openings leading to the crankcase 246, thus providing cooling of the internal components by forcing the fresh fluid supply to flow through the crankcase and around the drive mechanism before entering the displacement chambers.

The cavity 242*a*, is formed by partitions 238, 248*a*, 252*a* and 254*a*; the cavity 242*b* is formed by partitions 238, 248*b*, 252*b* and 254*b*; the cavity 242*c* is formed by partitions 238, 248*c*, 252*c* and 254*c*; the cavity 242*d* is formed by partitions 238, 248*d*, 252*d* and 254*d*. The cavity 242*a'* is formed by partitions 238', 248*a'*, 252*a'* and 254*a'*; the cavity 242*b'* is formed by partitions 238', 248*b'*, 252*b'*, and 254*b'*; the cavity 242*c'* is formed by partitions 238', 248*c'*, 252*c'* and 254*c'* and the cavity 242*d'* is formed by partitions 238', 248*d'*, 252*d'*, and 254*d'*. Conventional sealing material and methods provides sealing between the various partitions and the casing 115.

As shown in FIGS. 4, 5, 6 7 and 9, the supply ports 125 and 125' in the shell half 62*a* are connected to ducts 255 and 255'. Each duct directs the fluid flow toward opposite ends of the housing 62 where it is drawn into the crankcase 246. The duct 255 is formed by partitions 238, 252*a* and 254*b*; the duct 255' is formed by partitions 238', 252*a'* and 254*b'*.

In an alternative arrangement, the relative positions of the piston and the chamber can be reversed so that the displacement chamber itself is driven in an orbital path while the piston is held in a fixed position in the direction perpendicular to the longitudinal axis of the crankshaft. Lateral movement of the piston in a direction parallel with the longitudinal axis of the crankshaft is permitted and advantage is taken of this movement to control the exhaust and input ports in manner similar to the first embodiment. As with the displacement chamber in the first embodiment, the piston is slidably coupled to the crankshaft to prevent excesive pressure against the outer casing.

I claim:

1. In a positive displacement apparatus, the combination comprising drive means for generating first and second eccentric motions, a first displacement chamber, means supporting said chamber to permit lateral movement thereof, a first piston moveably mounted within said chamber, and first and second connecting means connecting said piston to said drive means thereby to cause said piston to follow a predetermined orbit, said first connection means being offset laterally from said second connection means, the lateral component of movement of said piston causing corresponding lateral movement of said chamber.

2. The combination as claimed in claim 1 including means anchoring said chamber against radial movement with respect to said drive means.

3. The combination as claimed in claim 1 wherein said piston follows a circular orbit, and including means anchoring said chamber against radial movement with respect to said drive means, and intake and exhaust ports communicating with said chamber and operatively responsive to lateral movement of said chamber.

4. The combination as claimed in claim 1 wherein said drive means includes a crankshaft, an eccentrically-mounted bushing on said crankshaft, and means for varying the degree of eccentricity of said bushing.

5. The combination as claimed in claim 3 wherein said pistons each follow a circular orbit, and including first and second sets of intake and exhaust ports connected respectively to said first and second chambers and operatively responsive to lateral movement of said chambers.

6. In a positive displacement apparatus, the combination comprising drive means for generating an eccentric motion, first, second, third and fourth displacement chambers positioned in a common plane and at ninety degree angles from each other to form two sets of opposing chambers, means supporting each of said chambers to permit lateral movement thereof, four pistons each moveably mounted within one of said chambers, means connecting each of said pistons to said drive means thereby to cause each piston to follow a predetermined orbital path, the lateral displacement of said pistons causing a corresponding lateral movement of that chamber in which such piston is positioned, and intake and exhaust port means associated with each of said chambers and operated by lateral movement of the respective chamber.

7. The combination as claimed in claim 6 wherein said drive means includes a second means for generating an eccentric motion, and including a second means for connecting each of said pistons to said drive means displaced laterally from said first connection.

8. The combination as claimed in claim 7 including means anchoring each of said chambers against radial movement with respect to said drive means.

9. The combination as claimed in claim 6 including means connecting said first and third chambers into an integral structure for simultaneous lateral movement, and means connecting said second and fourth chambers into an integral structure for simultaneous lateral movement.

10. The method of positively displacing a fluid comprising the steps of drawing said fluid into first and second displacement chambers having first and second pistons, respectively, slidably mounted therein, moving each of said pistons along an orbital path and thereby modifying the volume of said chambers, said first and second pistons being positioned in a common cross-sectional plane, and restricting each of said chambers from movement in a direction parallel with the sliding movement of said piston in said chamber while permitting movement of each of said chambers in another direction.

11. The method as claimed in claim 10 including the step of controlling the intake and exhaust of fluid into and out of said chamber as a function of the lateral displacement of said chamber.

* * * * *